US005800325A

United States Patent [19]

Wilkes

[11] Patent Number: 5,800,325

[45] Date of Patent: Sep. 1, 1998

[54] HIGH SPEED MACHINE AND METHOD FOR FABRICATING POUCHES

[76] Inventor: Kenneth R. Wilkes, 55 Brookwood Rd., Asheville, N.C. 28804

[21] Appl. No.: 824,817

[22] Filed: Mar. 26, 1997

[51] Int. Cl.[6] ..... B31B 1/92

[52] U.S. Cl. ..... 493/22; 493/29; 493/196

[58] Field of Search ..... 493/22, 29, 194, 493/195, 196, 210, 224

[56] References Cited

U.S. PATENT DOCUMENTS 4,070,951 1/1978 Bala ..... 493/29
4,545,780 10/1985 Martin ..... 493/11
4,597,748 7/1986 Wolf ..... 493/29
5,617,709 4/1997 Hartman ..... 53/435

*Primary Examiner*—Jack W. Lavinder
*Attorney, Agent, or Firm*—Saul Epstein

[57] ABSTRACT

A pouch making machine which simultaneously creates perimeter seams for a plurality of pouches on a web and temporarily stores the seamed web in an accumulator at the conclusion of the seaming step, and then withdraws the web from the accumulator to sever the individual pouches from the web. The withdrawal of the web from the accumulator is carried on independent of the seaming step, except that regulating means is included to make the long term average web speed the same through the seaming step and the cutoff step.

9 Claims, 3 Drawing Sheets

HIGH SPEED MACHINE AND METHOD FOR FABRICATING POUCHES

BACKGROUND OF THE INVENTION

This invention relates to the fabrication of pouches, particularly those intended for storing sterile items, as for example medical and surgical instruments. In particular, the invention relates to a means for fabricating pouches at speeds significantly higher than heretofore practical.

One form of pouch commonly used for storing sterile items, and for other uses, consists of two similarly sized rectangular sheets seamed to each other around their peripheries, using heat and pressure. If intended for gas sterilization (e.g. ETO (ethylene oxide) or steam) one of the sheets is a made from a porous material which is permeable to the sterilizing gas, but is impermeable to bacteria and the like. This membrane could be, for example, surgical paper or a spun olefin (such as sold by the DuPont Company under the trade name of Tyvek). The second sheet is usually a transparent non-porous plastic sheet, such as polyethylene, which is impervious to both gas and bacteria. In pouches intended for radiation sterilization, neither of the sheets need be porous; both can be polyethylene, or other suitable material.

Another type of pouch which is often used for gas sterilization further includes a third sheet, or interlayer, between the gas-permeable and the non-permeable sheets described above. The interlayer sheet is usually perforated, or otherwise has one or more openings to permit gas to flow easily. The purpose of the interlayer is to achieve a peelable bond with the impervious sheet which does not create shreds or other free particles when the pouch is opened. Uncoated surgical paper and Tyvek tend to shred, and hence, the use of a non-shredding interlayer sheet permits these products to be used in sterilizable pouches.

A myriad of other pouch constructions have been devised over the years, of which a great many are presently in commercial use. A number of examples of pouch designs can be found illustrated in U.S. Pat. Nos. 3,754,700, 4,367,816, 5,549,388, and 5,551,781, and in many other patents. The present invention is suitable for fabricating many different package structures, and the term "pouch" as used herein is intended to include all of the various package types which can be fabricated in the manner described.

Whatever the style, pouches are usually made on a machine wherein the various required constituents of the pouch are supplied as webs from large rolls of the respective materials. As the materials are fed through the pouch making machine, the various webs which are used to create the pouch are brought into face to face contact, and the required peripheral and other seams are made. The seams are commonly made by pressing the areas to be seamed together between a heated seaming iron (which has the form of the desired seam pattern) and a platen. Since it takes some time (generally of the order of one second) to create a seam in this manner, the web feed is made intermittent, the feed being stopped during the time the seaming iron is pressing against the platen, and then the web moved to bring the next area to be seamed under the seaming iron.

Other operations which may be needed to be performed on the materials making up the pouch, such as cutting openings in one or more webs, etc., are synchronized with the seaming cycle.

As noted above, pouch seams are most commonly made by the application of heat and pressure to the seam areas, and the present invention is described herein using that as the method. Under some circumstances, however, it may be convenient to make some or all of the seams using adhesives rather than heat to cause the various films to adhere, and it will be understood that the principles of the present invention, as described below can be used to fabricate pouches using adhesive technology in place of heat and pressure.

After the needed peripheral and possibly other seams are made, a fresh web area is moved under the seaming iron and the previously seamed area is moved to a cutoff knife, where the completed pouches are severed from the web. The cutoff knife is not usually located immediately adjacent the seaming iron; for practical space reasons, normally there are one or more patterns of perimeter seams between the seaming iron and the cutoff knife, and one or more additional seaming cycles usually occur before the seamed section just made arrives at the cutoff knife.

Cutoff knives generally operate much faster than do the seaming irons; for example, knives operating at a rate of five cuts per second or even faster are available. The cutoff cycle in prior art pouch making machines is also synchronized with the seaming cycle, the cutoff function being idle while the seams are being made (since the web is stationary) and operating while the web is being fed to bring a new area to be seamed under the seaming iron.

In order to achieve relatively high production, it is common to utilize seaming iron assemblies which can make the seams for many, say ten, pouches at a time along the length of the web. Hence, in such a machine, pouches are made in two consecutive timewise steps: 1) seaming a plurality of pouches simultaneously, and 2) sequentially cutting off completed pouches. Assuming a seaming iron ten pouches deep, if it takes one second to make the seams for the ten pouches, it will take about an additional two seconds to cut the pouches off the web (at a rate of five per second), for a total of three seconds to make the ten pouches. This is a theoretical rate of 200 pouches per minute. Actually, there is usually some waste start and stop time which will reduce this production rate somewhat.

The present invention improves the rate of production of pouch making machines by permitting the cutting off of the completed pouches to proceed even while the web is stationary in the seam forming portion of the machine (while the seams are being created). The pouch severing operation and the seaming operation, according to the present invention, are carried out independently of each other, and simultaneously, instead of sequentially, as in the prior art.

It is an object of the present invention to provide a pouch fabricating machine and method which improves on the production rate obtainable with prior art pouch fabricating machines.

SUMMARY OF THE INVENTION

In the pouch making method of the present invention, the seaming and cutoff operations are not done sequentially, as in the prior art, but are rather carried out simultaneously and continuously. Pouch production is therefore not a function of the sum of the amount of time it takes to create the seams and the time to sever the pouches from the web, as in the prior art, but rather, is determined by the time to achieve only one of these functions. Hence the production rate is inherently higher than in comparable prior art pouch fabricating machines In accordance with the present invention, the input webs are fed to the seaming iron, and the peripheral and other seams are made as in the prior art. But when the seams are finished, the web is not fed directly to the cutoff knife, as was done in prior art machines, but is rather fed to an accumulator which accepts the intermittently moving web, and temporarily stores it. The material entering the accumulator from the seaming operation is fed out of the accumulator, as required, to the pouch severing portion of the machine, where the pouches are severed from the web. The pouch severing portion of the machine draws material from the accumulator one pouch length at a time and severs the pouches one at a time, independent of whether or not the web motion is stopped at the seaming iron during the seam forming cycle.

The timing of the seaming operation and the severing operation are grossly different, but because an accumulator is provided as a buffer between the two operations, both can be function simultaneously. The seaming cycle requires the web to be stationary for approximately one second per cycle, whereas the cutoff cycle requires the web to be stationary for only milliseconds per cut. Similarly, the moving parts of the cycles are also different; the seaming cycle requires the web to move many pouch lengths per cycle, whereas in the cutoff cycle the web moves only one pouch length per cycle. While the long term average web speed past the seaming iron and the cutoff knife are the same, the instantaneous speeds are vastly different, the accumulator absorbing the short term differences in web travel. By long term average is meant an average taken over many seaming cycles.

Using the representative pouch making machine referenced in the prior section as an example, namely, a machine having a ten pouch deep seaming iron utilizing a one second dwell for seaming, and a cutoff knife capable of cutting off five pouches per second, a machine according to the teachings of the present invention would be capable of a production of 300 pouches per minute. This is a fifty percent increase over a comparable machine using prior art technology. The intermittent web feed to the seaming iron in the machine just described would include a one second feed, and a one second dwell while the seams are being made, for a total of two seconds per ten pouches, i.e., five pouches per second. The cutoff knife, operating at a rate of five pouches per second, takes the web out of the accumulator at the same average rate as the seams are being made.

The production rates cited above are, of course, merely representative of the production which can be achieved. If a faster cutoff knife were available, the feed rate of the webs to the seaming iron could be increased so that the overall seam cycle time (in seconds per pouch) is decreased to match the faster cutoff knife speed. If the maximum practical web feed rate to the seaming iron is insufficient to match the available cutoff knife speed, the depth of the seaming iron can be increased until the rates of the two operations (in pouches per minute) are substantially matched. Practical and/or economic considerations may, of course, dictate that a particular machine be operated at less than its maximum theoretical production rate.

The invention is described in greater detail in the below detailed description and the accompanying drawings, from which a more comprehensive understanding of the invention may be had.

DETAILED DESCRIPTION OF THE INVENTION

Figure 1:
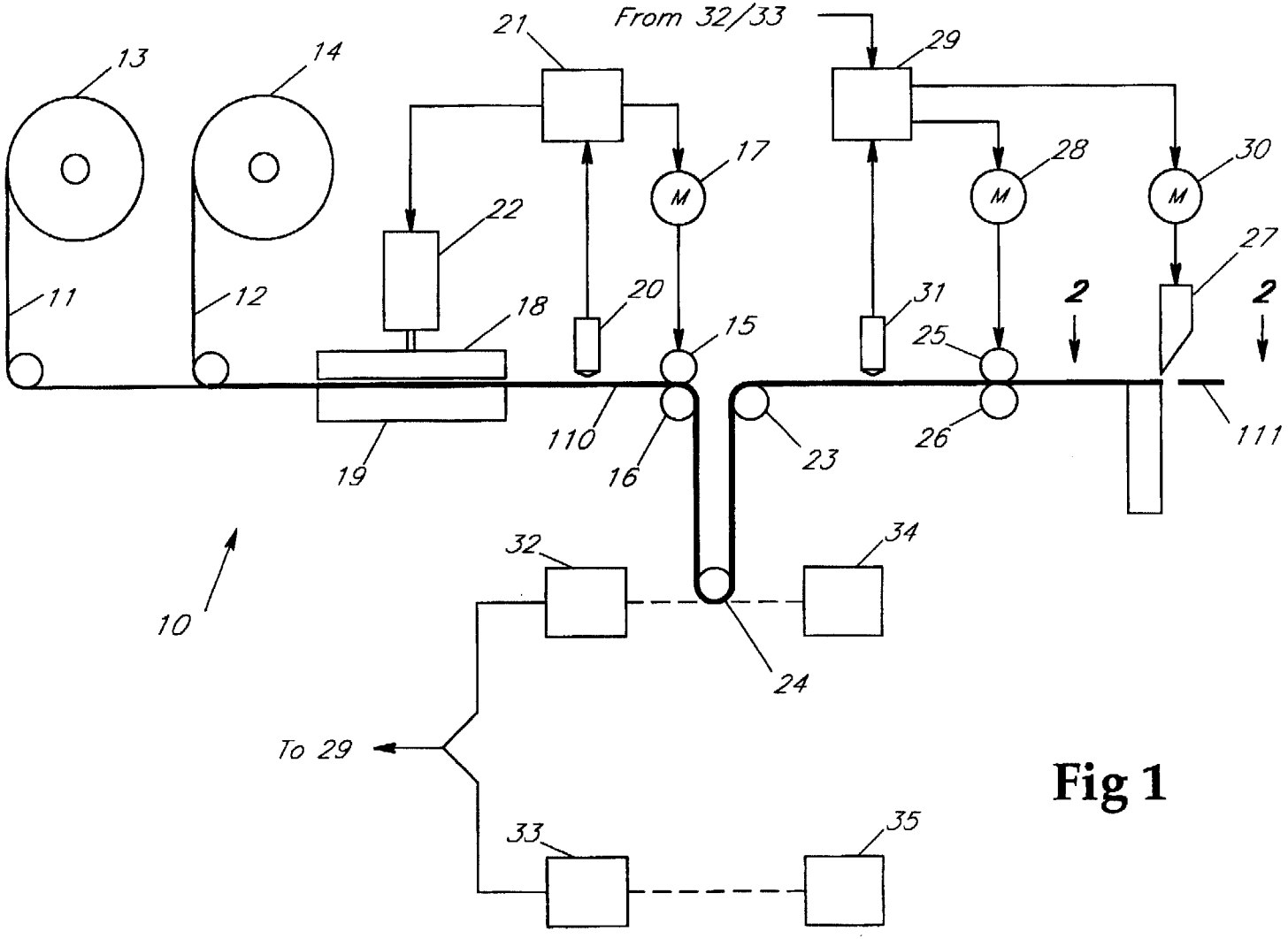
FIG. 1 is a schematic side view of a representative pouch making machine embodying the present invention, and further includes a block diagram representation of a presently preferred version of control circuitry for coordinating the various functions.
Figure 2:
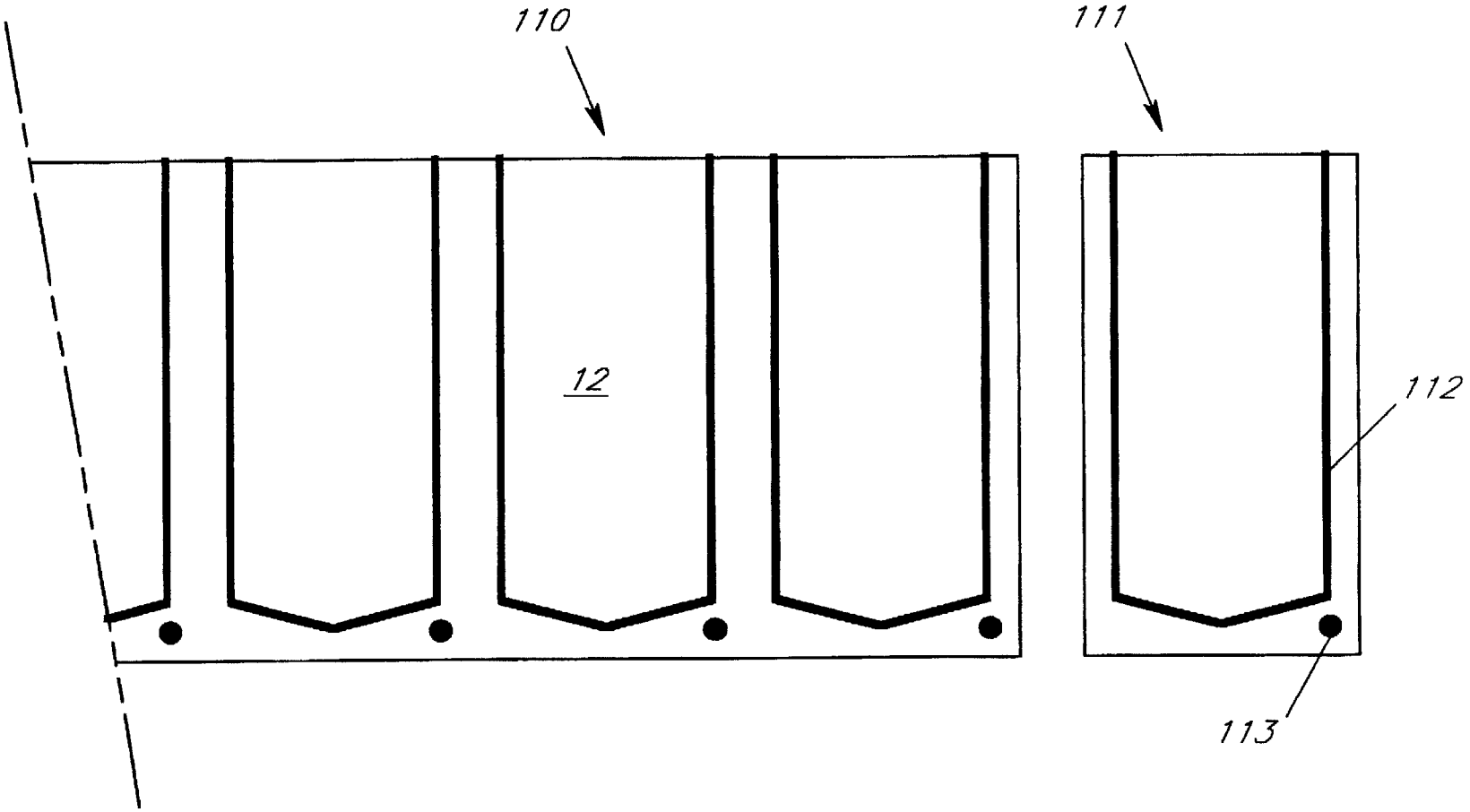
FIG. 2 is a top plan view of a portion of a web in process in the machine of FIG. 1, the portion shown being at 2—2 of FIG. 1. A completed pouch severed from the web is also shown in the figure.

FIG. 1 is a schematic side view of a pouch making machine embodying the present invention. For illustrative purposes, a machine is shown which produces a conventional "chevron" pouch. Such a pouch consists of two rectangular sheets seamed together around three of its four sides, the fourth side seam being made after the pouch is completed and the desired contents inserted. The seam on the side of the pouch opposite the omitted seam is in the shape of a chevron, hence the name. FIG. 2 illustrates a portion of the web (110) just before it reaches cutoff knife 23, and also a completed pouch (111) after it has been severed from the web. As will be discussed below, the pouches fabricated by the machine of FIG. 1 start out as two webs of pouch material 11 and 12. These two webs are joined by being seamed together to form a single web 110. The top web 12 is visible in FIG. 2, the bottom web 11 being behind the web 12 in the figure, and not visible. The seams which define the bounds of each pouch made out of the two webs of material are designated by the numeral 112.

The construction of pouch making machines in general are well known in the art so that constructional details are unnecessary to convey a knowledge of the invention to those skilled in the art. The below description of the invention assumes, as an example, that the seaming iron used to create the perimeter seams on the pouches being fabricated is ten pouches deep, i.e., it simultaneously forms the seams for ten pouches along the machine direction. The depth of the seaming iron is a matter of economics and convenience; any desired number can be used in connection with the present invention.

Similarly, the seaming iron may be any number of pouches wide, as is economical under the circumstances. The following description will assume that the seaming iron is only one pouch wide, but it will be appreciated that this is an arbitrary choice for convenience in explanation. If the machine were more than one pouch wide, it would be necessary to slit the web apart between the pouches before the final cutoff step, but otherwise the explanation of the process would be identical to that which follows.

As seen in FIG. 1, two webs of sheet stock 11 and 12 are fed into the pouch making machine 10 from rolls 13 and 14. The webs 11 and 12 are drawn into the machine by rollers 15/16. One or both of these rollers are driven by motor 17. The motion is intermittent in that the webs are drawn rapidly into the machine for a period of time, and then the motion stops for some other period of time to allow the perimeter seams of the pouches to be made by hot seaming iron 18 being pressed against platen 19. The seaming iron 18 is pressed against platen 19 by one or more hydraulic or air cylinders 22 under the control of control system 21. The temperature of seaming iron 18, and the duration of the pressing cycle are variables which depend on the particular materials used and the characteristics of the seam desired. A common duration for the pressing cycle is about one second. After the perimeter seams are made and seaming iron 18 released, rollers 15/16 draw the webs through until the material for the next set of pouches is in position to have the perimeter seams created. It is preferred that web 12 contain indicia (shown as marks 113 in FIG. 2) spaced one pouch length apart. Photosensitive sensor 20 is positioned to detect the marks, and control system 21 causes the rollers 15/16 to stop at every tenth mark to permit the seams to be formed. If marks 113 are not provided, as an alternative, control system 21 can be arranged to cause a predetermined fixed length of material to be drawn in on each cycle. Means for accomplishing feeding functions by predetermined lengths are known in the art, and need not be described here.

As the rollers 15/16 are drawing the webs 11 and 12 under the seaming iron, the web section on which pouch seams have previously been formed is passed into the accumulator portion of the machine. The accumulator is the portion of the machine between rollers 15/16 and roller 23. As the web 110 is fed into the accumulator, gravity causes dancer roller 24 to move downward and accommodate the web being fed in. Dancer roller 24 is preferably heavy enough to keep the web taut. The term accumulator as used herein refers to a section of a pouch making machine which temporarily stores varying amounts of web material so as to permit the instantaneous velocity of the web entering the section to not necessarily be the same as the instantaneous velocity of the web leaving the section. Such instantaneous input/output velocity differences cause the amount of web material stored in the accumulator to vary with time.

While the web is being fed into the accumulator by rollers 15/16, rollers 25/26 withdraw material from the accumulator and feed it to cutoff knife 27, where the individual pouches are cut off the web. Rollers 25/26 are intermittently driven by motor 28 under the control of control system 29, advancing the web one pouch at a time to the cutoff knife, and stopping to permit the knife to sever the pouch. Motor 30 operates cutoff knife 27. Photosensitive sensor 31 detects marks 113 on web 12 as rollers 25/26 feed the web out of the accumulator, and causes rollers 25/26 to stop momentarily at each mark so as to permit the cutoff knife 27 to operate. If marks 113 are not provided, in the same manner as mentioned above in connection with control system 21, control system 29 can be arranged to feed the web a predetermined length (i.e., one pouch length) between cutoff operations.

The difference between the motion of rollers 15/16, and 25/26 is that rollers 15/16 advance the web ten pouch lengths per seaming cycle, whereas rollers 25/26 advance the web one pouch length per cutoff cycle. While the long term average speed of the web leaving the accumulator is set to be the same as that of the web entering the accumulator, the instantaneous speeds are obviously quite different. The accumulator absorbs the short term variation in input/output material caused by the differences in instantaneous speed. By short term variation is meant the differences occurring within some relatively small number of seaming cycles. Long term, on the other hand, refers to many seaming cycles.

There are a number of possible ways to regulate the long term average web speeds so as to not exceed the capacity of the accumulator. A presently preferred way of accomplishing this function is to set the average web speed at rollers 25/26 over a single cutoff cycle to be slightly higher than the average web speed at rollers 15/16 over a single seaming cycle, and to energize the drive mechanism for rollers 25/26 only if there is more than a certain amount material in the accumulator. In order to accomplish this method, upper and lower photosensitive position detectors 32 and 33 are provided, with associated light sources 34 and 35. As material is fed into the accumulator by rollers 15/16, dancer roller 24 drops until its position is detected by detector 33. At that point, the pouch cutoff mechanism, i.e., motors 28 and 30 which drive rollers 25/26 and cutoff knife 27, is energized by control system 29, and the cutoff knife 27 continues to sever pouches from the web until detector 32 detects that roller 24 is above the upper detector position, at which time the cutoff mechanism is deactivated until restarted by the dancer roller 24 dropping to the lower detector position again. It will be appreciated by those skilled in the art that types of sensors 32 and 33, other than photoelectric, could be used to sense the position of dancer roller 24, such as proximity detectors, etc.

Figure 3:
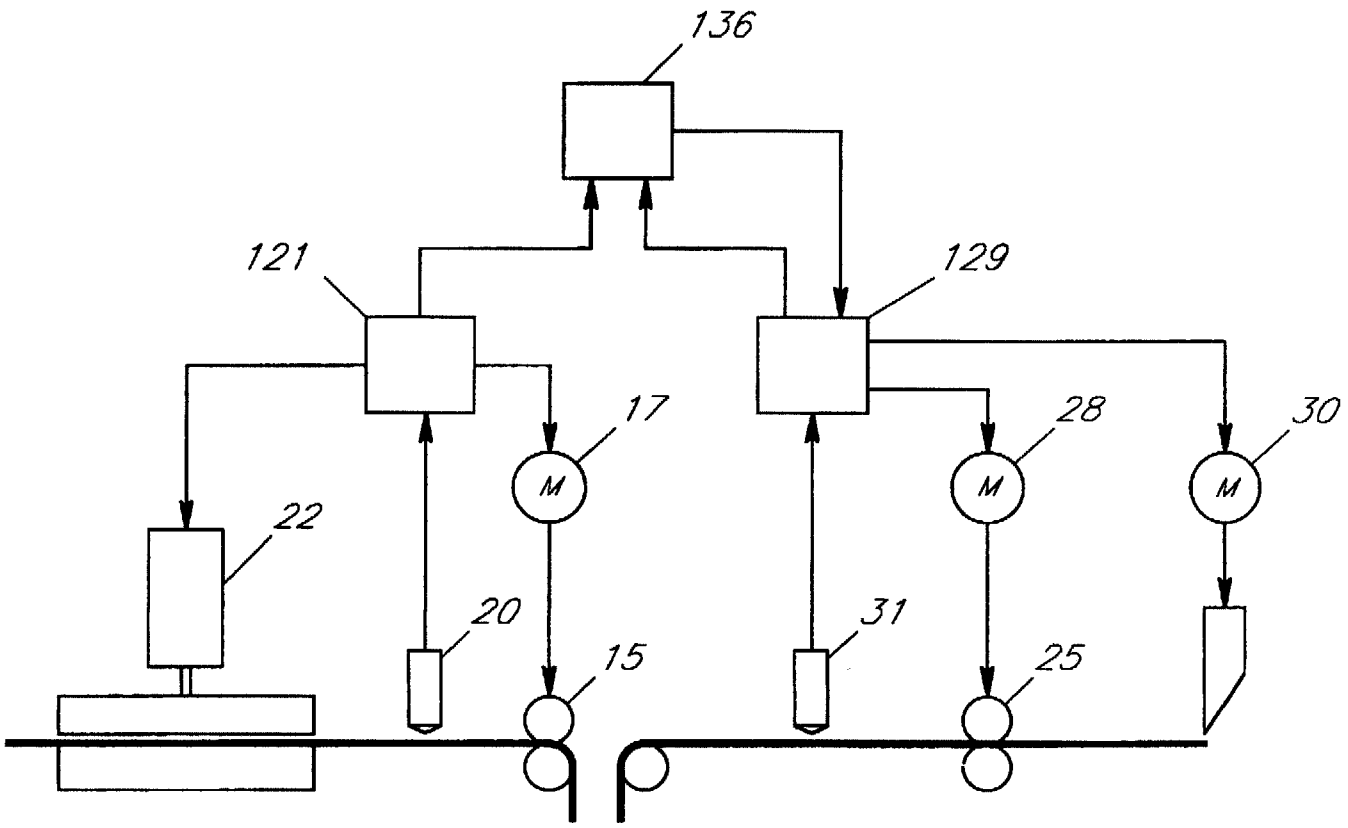
FIG. 3 is a block diagram of an alternate method for regulating the relative speeds of the two feed motors of the machine of FIG. 1.

A second way of regulating the relative average speeds of the web entering and leaving the accumulator is illustrated by the block diagram of FIG. 3. In FIG. 3, the elements of the embodiment of FIG. 1 which are unchanged bear the same numbers as shown in FIG. 1. Elements which appear in FIG. 1, but may be somewhat modified for the embodiment of FIG. 3, bear numbers which are 100 greater than in FIG. 1. In the system of FIG. 3, pulses generated by photosensitive sensors 20 and 31, when detecting marks 113, are fed through control systems 121 and 129 respectively to up/down counter 136, one of the sensors causing the count to increase, and the other causing the count to decrease. At the end of each seaming cycle, control system 129 checks the status of up/down counter 136 to determine whether more marks have been detected by sensor 20 or sensor 31, and the speed of motor 28 is altered by control system 129 in the direction tending to bring the count of up/down counter 136 back toward zero.

It will be appreciated that instead of varying the speed of motor 28 to maintain the count near zero, the speed of motor 17 could be varied to achieve the same result. Similarly, in the first control system embodiment described, instead of the photosensitve position detectors 32 and 33 controlling the speed of motor 28 through control system 29, they could, with the same end result, control the speed of motor 17 through control system 21.

What has been described is a machine and method for fabricating pouches at speeds which have heretofore been considered impractical. Persons skilled in the, art will no doubt be able to make various modifications and adaptations of the invention but yet be within the inventive teachings disclosed both explicitly and implicitly herein. The limits of the invention sought to be protected are defined by the following claims.

I claim:

1. A machine for fabricating pouches which comprises:

seaming means having a pattern for simultaneously creating seams which define more than one pouch;

means for drawing a web comprised of at least two thicknesses of pouch materials from one or more rolls of said pouch materials into position to have seams created by said seaming means;

first control means for controlling said drawing means and said seaming means whereby successive patterns of seams are created on said web by said seaming means;

an accumulator for temporarily storing a portion of said web of pouch material which includes said seams;

a pouch cutoff knife;

means for feeding portions of said web out of said accumulator and to said cutoff knife to regulate the amount of said web in the accumulator; and second control means for controlling said feeding means and said cutoff knife.

2. A machine for fabricating pouches as recited in claim 1 wherein said second control means includes means for energizing said feeding means and said cutoff knife when the amount of said web in said accumulator exceeds a first predetermined amount, and for deenergizing said feeding means and said cutoff knife when the mount of said web in said accumulator is less than a second redetermined amount.

3. A machine for fabricating pouches as recited in claim 1 wherein said first and second control means each includes sensors for detecting indicia on said web and further includes means for causing said web to be positioned relative to said indicia for creating said seams and for cutting off said pouches, respectively.

4. A machine for fabricating pouches as recited in claim 3 wherein said sensors are photoelectric devices.

5. A machine for fabricating pouches as recited in claim 1 and further including means for adjusting the relative rate at which said patterns of seams are created and at which said pouches are cut off whereby the average number of pouches cut off per unit of time equals the average number of pouches whose seams are created per unit of time.

6. A method of fabricating pouches which comprises the steps of:

providing a web of pouch material comprised of at least two thicknesses of said web material;

creating successive patterns of seams between said thicknesses of pouch material, each of said patterns including seams which define two or more pouches, each of said pouches having a predetermined length, and each of said patterns having a predetermined length;

feeding said web containing said patterns of seams to an accumulator for temporary storage, one pattern length of said web per seaming cycle; and withdrawing said web from said accumulator and severing said pouches from said web.

7. The method of fabricating pouches as recited in claim 6 which further comprises the steps of:

ascertaining the amount of said web stored in said accumulator; and withdrawing said web from said accumulator and severing said pouches from said web so long as the amount of said web stored in said accumulator exceeds a predetermined amount.

8. The method of fabricating pouches as recited in claim 6 which further comprises the steps of:

sensing indicia on said web and positioning said indicia relative to a seaming means so as to create said patterns of seams with a predetermined relationship to said indicia; and sensing said indicia and positioning said indicia relative to a cut off knife so that said pouches will be severed with a predetermined relationship to said indicia.

9. The method of fabricating pouches as recited in claim 6 which further comprises the step of adjusting the average number of patterns of seams created times the number of pouches defined by each said pattern per unit time to be equal to the average number of pouches severed from said web per unit of time.

* * * * *